United States Patent [19]

Morton

[11] 4,195,288

[45] Mar. 25, 1980

[54] ALARM SYSTEM

[76] Inventor: Henry H. Morton, 100 Covington St., Wadesboro, N.C. 28170

[21] Appl. No.: 879,428

[22] Filed: Feb. 21, 1978

[51] Int. Cl.[2] ..... G08B 19/00

[52] U.S. Cl. ..... 340/539; 340/517; 340/531

[58] Field of Search ..... 340/538, 539, 509, 679, 340/52 F, 53, 517, 531, 521

[56] References Cited

U.S. PATENT DOCUMENTS

| | | | |
|---|---|---|---|
| 3,009,134 | 11/1961 | Brosh | 340/539 |
| 3,988,730 | 10/1976 | Valker | 340/52 F |
| 4,012,728 | 3/1977 | Fowler | 340/539 |

*Primary Examiner*—Alvin H. Waring

[57] ABSTRACT

An alarm device and system which is adaptable to a variety of uses and conditions for protecting homes, equipment, buildings and the like by alerting or informing distant or nearby personnel to changes of conditions from within predetermined limits.

11 Claims, 7 Drawing Figures

TRANSMITTER
AUDIO-VISUAL INDICATOR
SHUTDOWN MECHANISM
RADIO TRANSMITTER
PROGRAMMING MEANS
REMOTE SENSOR
REMOTE SENSOR
CONTROL CIRCUITRY
LOGIC CIRCUITRY
POWER SUPPLY
ANALYZER CIRCUITRY
21-S

ALARM SYSTEM

BACKGROUND AND OBJECTIVES OF THE PRESENT INVENTION

Various monitoring equipment has been used for many years in industry to alert workmen that pumps, heating units, refrigeration apparatus or other devices are beginning to exceed certain specified limitations including temperature changes, maximum or minimum capacities, velocities, weights and other conditions. Likewise, instrusion protection devices have been widely used in recent years to alert security personnel to the unauthorized entry by burglars or others in particular areas of industrial plants or office buildings and homes.

The security devices used to date have achieved some degree of success but all have been lacking in providing the versatility and capabilities required in meeting changing and growing demands by the user.

With this background in mind the present invention was conceived and one of its objectives is to provide a monitoring device for mechanical, electronic, or electrical equipment.

Another objective of the present invention is to provide a monitoring and alarm system which employs a condition alert link (CAL) which will transmit signals by wire or by wireless method from condition response monitor to selected locations for alerting authorized personnel.

It is still another objective of the present invention to provide a variety of alarms or warning signals to identical or different locations which identify locations and/or types of condition violation.

It is also an objective of the present invention to provide a portable signal alarm receiving device whereby workmen can be notified of drastic changes in conditions as the workers move from one location to another.

It is another objective of the present invention to provide a monitoring system which will shut-down equipment such as motors or engines if necessary and activate devices to remedy violations while simultaneously providing a warning signal such as a flashing light or audible sound and dial programmed telephone numbers to alert proper authroities of the pending danger.

It is still another objective of the present invention to provide a monitor and alarm system which will monitor buildings or other structures for unauthorized intrusions, fires, floods, or other dangerous conditions.

It is yet another objective of the present invention to provide a monitoring system by utilization of a single pair of electrical wires which greatly reduce the installation cost and maintenance to moniter multiple conditions and locations.

Another objective of the present invention is to provide a multi-functional alarm control unit which is easily operated and tested by unskilled personnel.

Other objectives and advantages of the present invention will be understood by those skilled in the art as the following specifications are reviewed.

SUMMARY OF THE INVENTION AND DESCRIPTION OF THE DRAWINGS

The alarm device of the present invention consists of monitoring equipment which is to be used or applied to an area of a building or equipment that is to be monitored such as a particular room that is to be guarded against unauthorized entry or could be adapted to monitor the oil pressure or water temperature of an engine during its operation. The sensing devices which are commonly known in the monitoring art feed information they receive to an "analyzer" circuit which compares the incoming data with programmed, pre-set limits. If the analyzer determines that the limits are exceeded, then a signal is dispatched to a logic circuit wherein a particular response is set in motion. The signals from the logic circuit pass to a control circuit wherein particular timing sequences transpire and external responses are transmitted. The responses transmitted may be radio signals sent to portable receivers or stationary receivers positioned at suitable locations either near the particular monitoring sensor or at some distant central control location. In addition to the radio signals that are transmitted to alert personnel to the particular problem that might be developing, simultaneous responses may be transmitted by conventional electrical wires or other means to sound, for example, a siren within a plant or outside of the plant or building, or the response signal may trigger the telephone dialing devices that place telephone calls to particular locations and give to the answerer at the location a recorded message. Various combinations of responses from the control circuitry may be useful at particular times, for example monitoring devices which demonstrate that a particular engine or other equipment is being subjected to unusually high temperatures, may alert inplant personnel so that they can attempt to immediately remedy the problem, while at the same time shutting down conveying equipment which is located near the overheated engine and, after a predetermined time, for example ten minutes, if the problem is not corrected, a telephone call is automatically placed to a maintenance supervisor at some remote plant miles from the problem location.

There are two types of radio receivers which may be employed with the present invention; one is a stationary unit which may be located at a central control area within a plant or building and may be, for example, connected to the telephone dialing apparatus for communication with selected personnel in the event of an emergency which cannot be remedied after a sufficient time period by in-plant workmen.

Additionally, a portable receiver may be carried by certain authorized personnel on the job site which will emit a "beeping" signal to alert those within its audible range of an impending danger or of certain condition changes. The portable units may be rechargeable from either 117 volts AC utility outlet or from a 12 volt DC supply such as from an automobile cigarette lighter receptacle.

Additionally, the portable receiver unit may include a pilot light for indicating when the unit is "on" or charging. A test switch may be provided for obtaining a sample "beeping" tone should it be desirable to test the unit prior to actual use conditions.

For additional versatility, a multi-function alarm control (MAC) unit may be incorporated into the stationary receiver as described above to provide a variety of simultaneous or independent alarm signals when activated by a single or multiple incoming signals. For example, the multi-function alarm control unit may include detection for burgulary, fire, robberies, medical emergencies, equipment failures such as overheating, pressure build-up, flooding and virtually all detectable alarm conditions. The MAC unit might for example, include a number of two-tone electronic sirens located at various places within a plant or building, and a multiple channel telephone dialing unit for calling a multiplicity of telephone numbers simultaneously. Auxiliary output connectors are provided within the MAC unit to provide electrical connections for performing such functions such as turning on area lighting, disconnecting electrical equipment, activating fire extinguishing equipment, closing or locking doors, opening or unlocking areas for acess by personnel and a multiplicity of other duties. In addition to being activated by radio waves, the MAC unit may be additionally activated by a protective electronic loop which is connected directly to the MAC unit and the MAC unit can be, for example, battery operated for up to 250 hours in the event of a utility power failure as would be caused by flooding, fires or other disasters.

Figure 5:
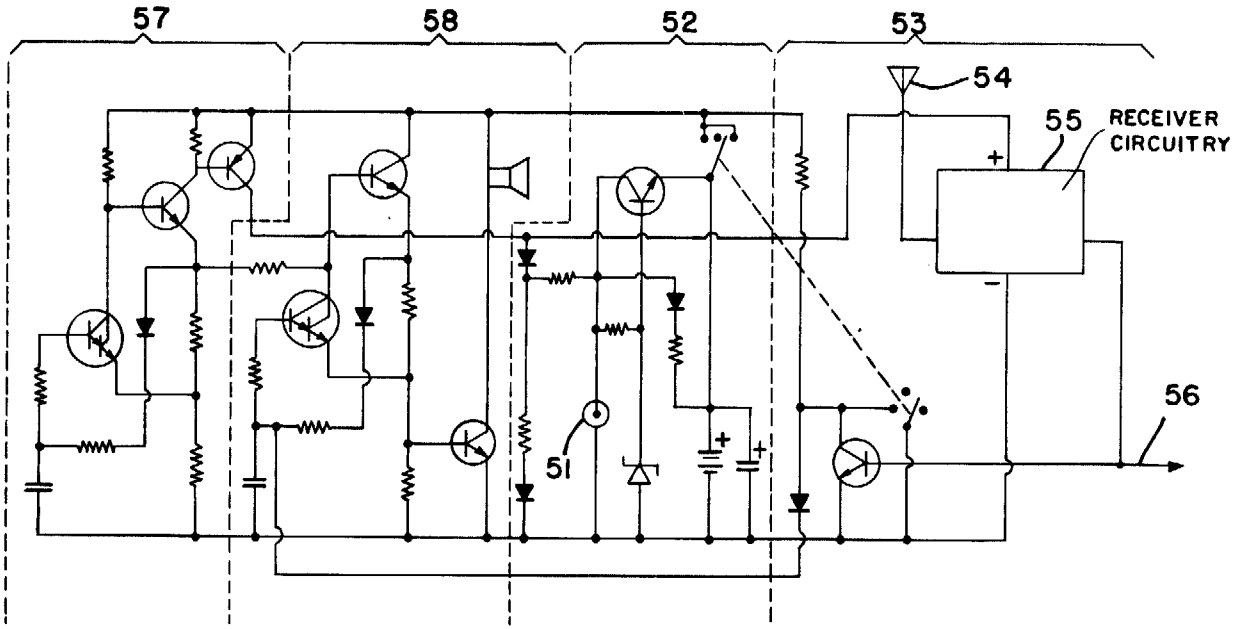
Figure 4:
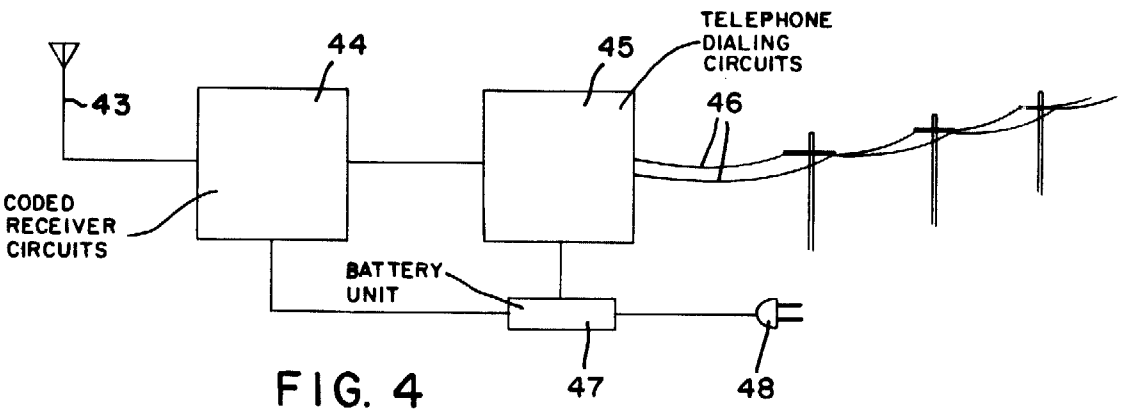
Figure 3:
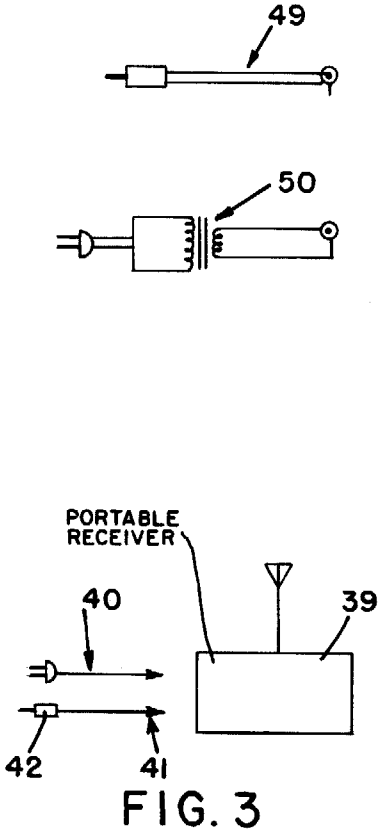
Figure 6:
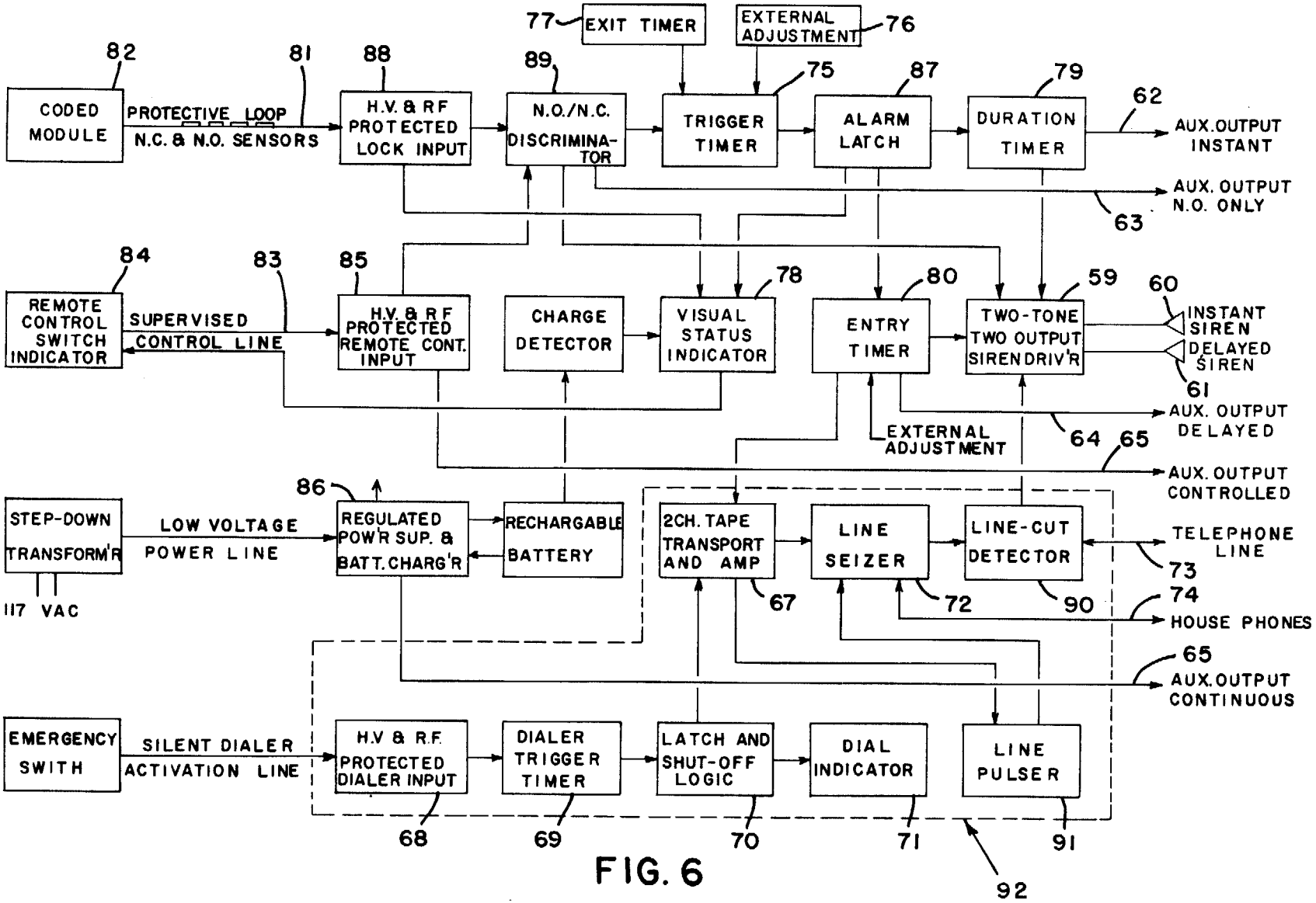
Figure 7:
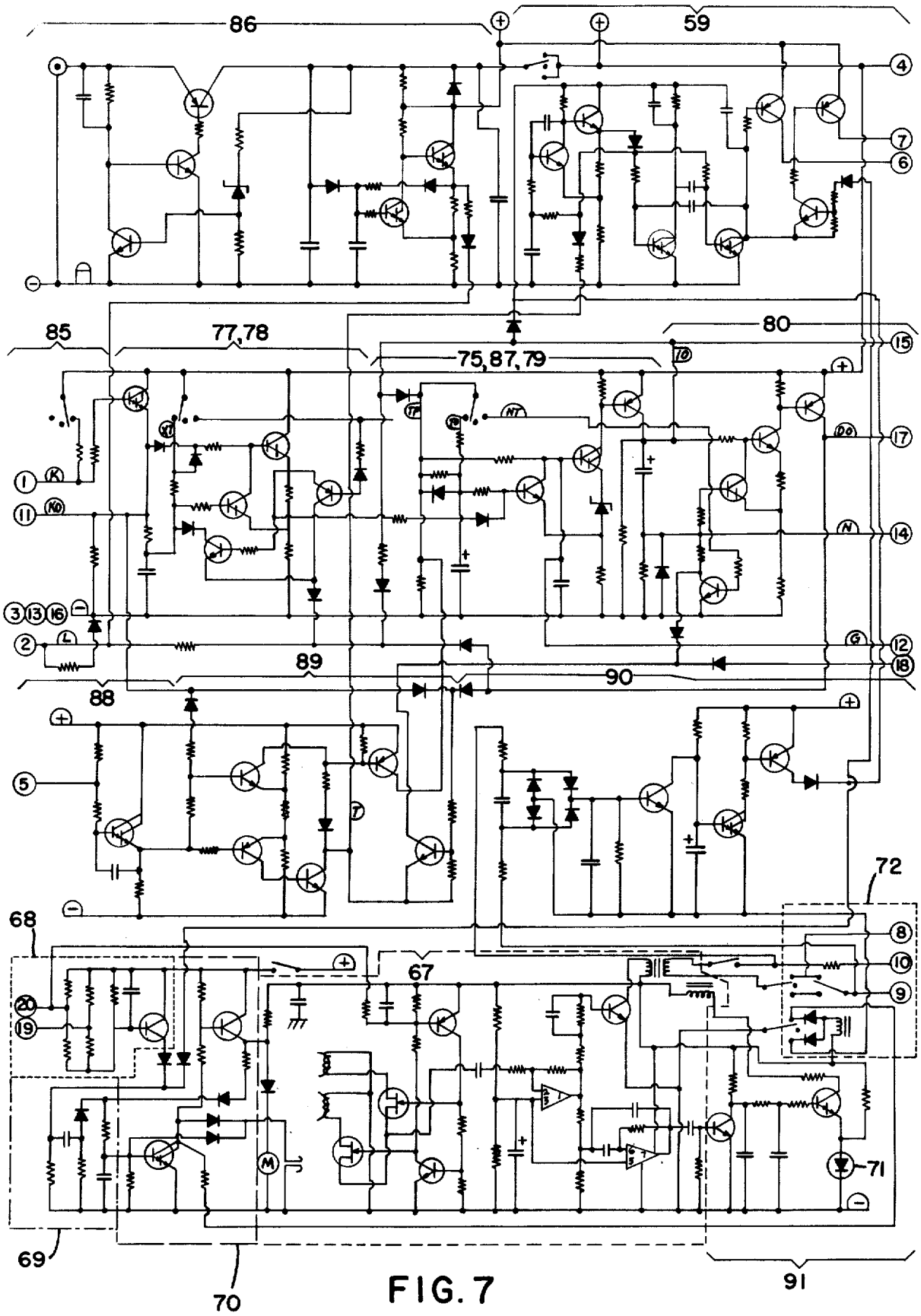

FIG. 3 demonstrates a portable receiver and alarm device;

FIG. 4 shows a stationary receiver which includes a telephone dialing unit;

FIG. 5 is a schematic circuit diagram of the receiver shown in FIGS. 3 and 4;

FIG. 6 demonstrates the multi-function alarm control (MAC) unit in block form; and FIG. 7 is a schematic circuit illustration of the MAC unit.

Figures 1, 2:
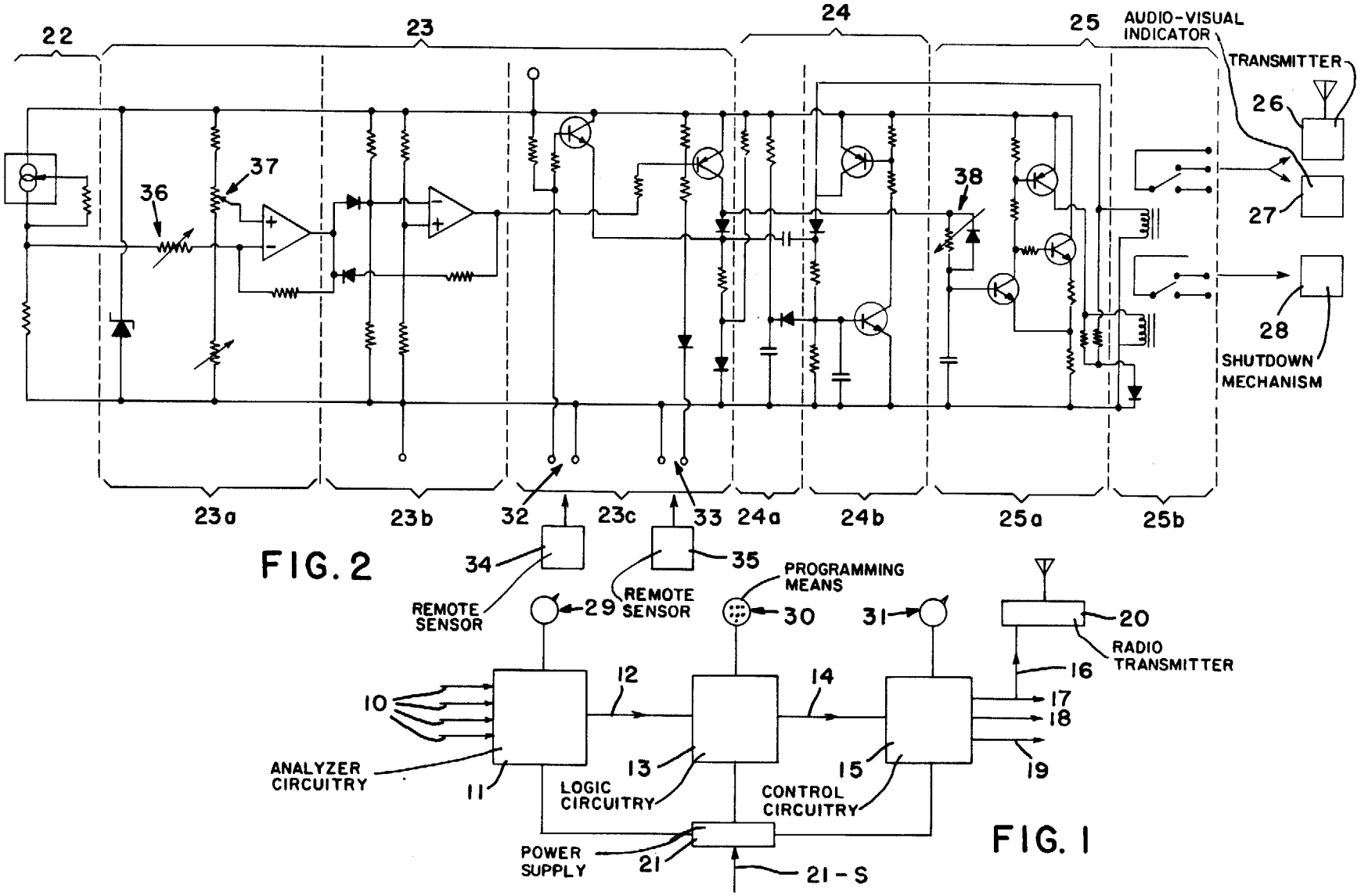
FIG. 1 is a block diagram of a transmitter as may be employed with the present invention.
FIG. 2 illustrates a schematic view of the circuits as may be employed in FIG. 1.

For a more detailed description of the drawings, turning to FIG. 1, arrows 10 demonstrate impulses transmitted from electronic or electromechanical sensors (not shown) which are known in the art and which relay information from selected monitored locations. The "information" or signals are delivered to analyzer circuitry 11 which compares the signal with stored data to determine whether or not the signal is within pre-set limits. If, for example, an engine is over-heating or if an unauthorized intrusion in a particular area being monitored is detected, then the analyzer circuitry forwards a signal 12 to logic circuitry 13. Logic circuitry 13 determines the response that is required and forwards a signal 14 to the control circuitry 15 which gauges the input 14 and transmits outgoing signals as shown at 16, 17, 18 and 19. Signal 16 causes activation of radio transmitter 20 which broadcasts its message to a portable and/or stationary receiver. As shown, signal 16 may be simultaneously sent with signal 17 which may be used, for example, to activate an audible or visual alarm. Additionally, signals 18 and 19 may also be simultaneously sent with signal 17 which may be used, for example, to activate an audible or visual alarm. Additionally, signals 18 and 19 may also be simultaneously sent or delayed and may be used to control or modify electrical supply sources for equipment in order to either turn off specified equipment or to activate equipment such as fire extinguishers. Power supply 21 is shown in FIG. 1 as providing the energy necessary to drive the circuitry and it may have batteries as a standby or as its main source of power and includes energy supply path 21-S.

The transmitter circuits as described in FIG. 1 are shown in more detail in FIG. 2 as one example though the transmitter is not intended to be limited to the exact circuitry embodiment shown. In FIG. 2, the transmitter may be utilized to monitor a temperature sensor mounted in a load (not shown) at some remote distance. The remote temperature sensor shown at 22 is connected to the analyzer circuit 23 corresponding to block 11 of FIG. 1. Logic circuit 13 of FIG. 1 is generally represented by section 24 of FIG. 2 and the timing and control circuit 15 of FIG. 1 is depicted in FIG. 2 at 25. The output control relays are shown in section 25*b* of FIG. 2 and several example devices are illustrated which may receive signals from the transmitter, including radio transmitter 26, audio/visual indicators 27, or equipment shut-down mechanism 28 which are known and conventionally used in the art. As shown in FIG. 2, section 23*a* amplifies the signal from the remote sensor and delivers the amplified signal to limit violation detector 23*b* of the analyzer circuit 23. A comparison is made between an amplified signal from the remote sensor and the norm according to a pre-set standard whereby the amplified signal is then delivered to initial trigger integrator circuitry 24*a* in the logic circuit 24. The analyzer circuit 23 may contain auxiliary sensor input terminals which may be for example identified as normally closed (32) or normally open (33) for receiving additional input signals from remote sensors 34 and 35 respectively. Remote sensor 34 may be used to monitor for example illegal entry or tampering, particular machine motions, pressure or fuel or oil supplies below a predetermined minimum. Remote sensor 35, may, for example, be concerned with oil pressure, water temperatures, battery voltage levels or freon levels or other conditions which require machinery shut-downs when dangerous operating conditions are approached as opposed to conditions monitored by remote sensor 34 which relates to conditions indicating prompt investigation by security, auxiliary or maintenance personnel.

Initial trigger integrator circuit 24*a* provides a unique advantage over control trigger circuits in that it does not transmit a violation, if violation condition is present when the transmitter is first turned on. Signal activation latch 24*b* comprises the logic circuit which is connected to the timing and control circuit 25 which includes shut-down discriminator and timer 25*a* and output control relay 25*b*. From the timing and control circuit 25, a signal or series of signals is delivered to alerting devices such as the audio-visual indicator 27 which may for example sound an alarm or activate a flashing light while simultaneously transmitting a radio signal through transmitter 26 to a remote receiver for alerting proper personnel. Additionally, shut-down device 29 may be activated for terminating the operation of particular equipment under certain prescribed conditions.

The parameter pre-set adjusting means 29 as shown in FIG. 1 is exemplified in sensor signal amplifier 23*a* by limit adjustment switch 36 and level adjustment switch 37. Also in FIG. 1 a function programming means 30 is illustrated for logic circuit 13 and this programming means 30 is illustrated for logic circuit 13 and this programming is set c - placed into operation at sensor input terminals 32 and 33 of auxiliary sensor input section 23*c* while timing pre-set mechanism 31 of FIG. 1 is depicted in FIG. 2 in shut-down discriminator and timer 25*a* by timing pre-set circuit 38.

The radio wave receiver which "hears" the special coded signal sent from the transmitter may have a reception range of some fifteen-hundred feet from the transmitter although longer reception ranges are possible depending on various conditions and modifications to the equipment which are well known by those skilled in the art and additionally, the transmitter may be coded if desired to provide a "combination lock" to prevent false triggering of the receiver.

Two different types of receivers can be used with the transmitter of the present invention as shown in FIG. 5, and FIG. 3 demonstrates the portable receiver 39 which is battery operated and may be recharged by auxiliary connector 40 by 115 volts AC whereby connector 41 utilizes 13 volts DC as would be obtained from an automobile by inserting terminal 42 into the cigarette lighter of a motor vehicle with a 13 volt electrical system. This portable receiver 39 is constructed to emit a highly audible intermittent tone or "beeping" sound which will attract attention of the carrier and other personnel which are nearby. A pilot light is provided in receiver 39 which indicates when the unit is on and/or when it is being charged. Also, the portable receiver 39 is provided with a test switch to provide the user to determine whether the "beeping" tone is properly working before putting it into field usage.

In addition to the portable receiver of FIG. 3, a fixed or stationary receiver is shown in FIG. 4 which includes antenna means 43, coded receiver circuits 44 and telephone dialing circuits 45 which may be an integral part of the multi-functional alarm control (MAC) as explained more completely herein. As shown in FIG. 4, the telephone dialing circuits 45 are connected to telephone wires 46 to illustrate a plurality of telephone messages may be forwarded when certain signals are received from the transmitter. In this the preferred embodiment of the receiver, a battery unit 47 powers the receiver and the battery unit 47 may be charged by the auxiliary plug 48 by utilizing 115 volts AC although other electrical sources may be used for charging the receiver illustrated in FIG. 4, as for example, with a 12 volt DC system.

The circuitry of the stationary receiver of FIG. 4 without the telephone actuating circuit is shown in FIG. 5 having auxiliary 12 volt DC supply element 49 and 115 volt AC auxiliary unit 50 which would be connected to input connector 51 illustrated in power supply section 52 of the receiver. It is understood that either unit 49 or 50 would supply 12 volt DC to the receiver. Adjacent to the power supply section of the receiver schematically shown in FIG. 5 is the receiver section 53 which includes antenna means 54, receiver circuitry 55 (not shown in detail) and signal transmission line 56 for activating a telephone dialing mechanism such as that shown at 45 in FIG. 4.

Also in FIG. 5 a schematic illustration of a duty cycle pulser is shown at 47 along with audio oscillator and speaker means in section 58.

In lieu or in addition to the telephone actuating or dialer circuits 45 the stationary receiver may be equipped with a multifunction alarm control unit which will greatly increase the flexibility and signal providing capacity of the receiving unit. The multi-function alarm unit as shown in FIG. 6 can include a multitude of signalling devices which may be employed such as the two-tone two output siren driver 59 having instant sirens 60 and delayed siren 61. Also, various auxiliary outputs are provided such as shown at 62 which can be described as an instantaneous auxiliary output 64, which is a delayed auxiliary output, 65 is a controlled auxiliary output which is activated whenever remote control switch 84 is "on", output 63 which is activated only on closure of a normally open sensor in protective loop 81, or 66 which provides a continuous 12 volts DC output for powering accessories. The auxiliary output section shown may be used to drive relays, for example, to turn on area lighting, shut-down equipment, activate fire extinguishing equipment, start recorders, activate remote indicators and signals, lock or unlock doors and other functions as may be required or helpful.

A two-channel tape transport and amplifier 67 is part of the telephone dialer 92 as is protected dialer input 68, dialer trigger timer 69, latch and shut-off logic 70, dial indicator 71, line seizer 72, line cut detector 90 and line pulser 91. This dialer mechanism will call up to eight phones per channel and play a recorded alarm message through telephone lines 74 while disabling all house phones that have access to that telephone line so that "jamming" of the alarm message will be prevented.

Of course, the multi-function alarm control unit as depicted in FIG. 6 may be operated in conjunction with the receiver as demonstrated in FIG. 4 and can be used independently to monitor various functions such as unauthorized entry, tampering pressure or temperature changes and other activities or conditions. The multi-function alarm control (MAC) unit as shown in FIG. 6 includes a trigger timer 75 which includes an external adjustment member 76 which may be for example adding external circuitry to prevent false alarms by requiring the alarm condition to presist for a pre-selected time interval prior to triggering. Also connected to trigger timer 75 is exit timer 77.

The circuitry as shown in FIG. 6 includes a built-in battery and charger that can power the unit for up to 250 hours in the event of an AC power failure and includes an indicator 78 which flashes in the event the charger circuit is faulty or the power fails. Duration timer 79, entry timer 80 and exit timer 77 provide automatic aiming, sequencing and reset features and are field adjustable for any particular application as required.

The protective loop 81 includes both normally open and normally closed sensor switches (not shown) and a coded module 82 for cooperation in preventing successful attempts to straight wire the protective loop to prevent alarm actuation. As another safety feature, the control line 83 which connects the remote control switch indicator 84 to the remote control indicator 85 is also supervised to prevent a burglar or other persons from cutting the line to render the MAC unit inoperable. Additionally, all inputs are protected from high voltage transients and radio signals which might cause interference or malfunction.

The telephone dialer 92 also has built in safeguards, and the house phones are disabled to prevent jamming the outgoing alarm messages whenever the telephone dialer 92 is in operation. Also, if the telephone lines are cut or rendered inoperable, the siren mechanism is immediately activated.

In a typical commercial application, the myriad of built in features makes the circuitry of the MAC unit adaptable to a variety of needs and functions and could perhaps be used for detection of burglaries, fires, robberies, and other dangers simultaneously.

Another unique feature of the MAC circuitry is its resetable exit timer.

When the burglary system is activated at the control panel or optional remote control indicator 84 a status light 78 indicates when all elements of the protective loop 81 are satisfied. An exit timer 77 allows, for example, two minutes to exit the protected premises before the system is armed though this relatively short time period may be adjustable as desired. Violations within the two minutes reset the timer to allow for "forgot something" return without de-activation. Also, as long as the violation exists, the timer 77 holds, and arming does not occur until two minutes after the loop 81 is satisfied. This permits, if so desired, unauthorized personnel the capability to arm the system without the capability to disarm the system.

Various adjustments can be made to the MAC circuitry, and as one example, a siren may sound immediately upon intrusion into a monitored area of the building. The siren may be silenced and the alarm disarmed at the control panel or at the remote control indicator 84 by executing the proper coded disarm procedure. In this manner, an additional degree of security is maintained since disarming requires both the right key and the right code to silence the alarm system.

Additionally, if the siren mentioned above is not disarmed within one minute, or other desired time range, the outside siren may be set to begin and the telephone dialer would be activated to begin dialing the numbers programmed on channel 1, for, example, to call police or other security personnel. The siren may continue their warning sounds for five-six minutes at which time they would automatically reset. Also, when the telephone dialer has completed its calls, it resets and the system is once again ready to report another violation.

To demonstrate the versatility of the MAC circuitry, if a fire is detected while the burglar system is not on, for example, in the event the premises are fully occupied, the siren which is placed inside the building would respond immediately to warn the occupants to evacuate while the outside siren and telephone actuating system are delayed for one minute to allow cancellation of the alarm in the event of a false triggering condition such as burned food or other easily controlled situations. Should a fire be detected while the burgular alarm is armed, for example, after working hours, the inside siren, outside siren and dialer activate immediately to give the earliest possible warning to prevent the least amount of damage. An emergency of this type can activate the telephone dialer whereby the second channel of the tape recorder will transmit a message to notify the local fire department or other authorized personnel. Also, the siren's tone can be varied; for example, a high, shrill pitch makes it suitable for identifying fires whereby a lower sound could be used to warn of unlawful intrusions.

A master test switch is provided on the control panel of the MAC which facilitates quick and easy testing of all timing functions, sirens, telephone dialer, and auxiliary output. This allows system checkout without actually triggering a violation.

The alarm is depicted in FIG. 7 with various sections being identified as they relate to the block diagram of FIG. 6. Of course, various modifications can be made to the circuitry shown in FIG. 7 and the schematic FIG. 7 is shown for illustrative purposes only.

Various other functions and conditions can be monitored in addition to the examples set forth herein and it is understood that an infinite variety of combinations and alarm signalling devices are suitable for use with the MAC unit.

The examples and illustrations contained in the specifications and drawings of the present invention are for illustrative purposes only and are not intended to limit the present invention.

I claim:

1. An alarm device comprising: a protective loop, said loop including a coded module and a pair of conductors joined to said coded module, said conductors connected to normally opened and normally closed sensing means, a multi-functional alarm control means connected to said conductors, said multi-functional alarm control means containing an analyzer circuit for discriminating between normally open or normally closed violations and having high voltage and radio frequency input protection, said coded module and said analyzer circuit cooperating to prevent defeat of said sensing means.

2. An alarm device as claimed in claim 1 and including a trigger timer circuit for measuring the duration of the normally opened or normally closed violation.

3. An alarm device as claimed in claim 1 and including a telephone dialing means.

4. An alarm device as claimed in claim 1 wherein said multi-functional alarm control means includes multi-alarm actuating circuits.

5. An alarm device as claimed in claim 1 wherein said multi-alarm actuating circuits includes a siren means and telephone dialing means.

6. An alarm device as claimed in claim 1, wherein said multi-function alarm control means includes an exit timer, said exit timer delaying the arming of said multi-functional alarm control for a predetermined time interval.

7. An alarm device as claimed in claim 1, and including a remote control switch indicator panel.

8. An alarm device as claimed in claim 7, wherein said remote control switch indicator panel includes a key switch for arming the alarm device.

9. An alarm device as claimed in claim 12 wherein said key switch cooperates with said multi-functional alarm control means for disarming the control device by coded switching procedures.

10. An alarm device as claimed in claim 7, wherein said remote control switch indicator panel includes an indicator means, said indicator means for determining sensing means status, activation status, power status and armed status.

11. An alarm device as claimed in claim 7, wherein said multi-functional alarm control means includes an entry timer, said entry timer being connected to a siren means and to a telephone dialing means, said entry timer selectively delaying the activation of said siren means and said telephone dialing means for a specified time interval.

* * * * *